US006357401B1

(12) United States Patent
Moriyama et al.

(10) Patent No.: US 6,357,401 B1
(45) Date of Patent: Mar. 19, 2002

(54) V-2 ENGINE

(75) Inventors: Hiroshi Moriyama; Makoto Yonezawa; Akihisa Shinoda, all of Wako (JP)

(73) Assignee: Honda Giken Kogyo Kabushiki Kaisha (JP)

( * ) Notice: Subject to any disclaimer, the term of this patent is extended or adjusted under 35 U.S.C. 154(b) by 0 days.

(21) Appl. No.: 09/696,769

(22) Filed: Oct. 26, 2000

(30) Foreign Application Priority Data

Nov. 4, 1999 (JP) ..... 11-314346

(51) Int. Cl.[7] ..... F02B 75/22
(52) U.S. Cl. ..... 123/54.4; 123/195 R
(58) Field of Search ..... 123/54.4, 195 R

(56) References Cited

U.S. PATENT DOCUMENTS 2,985,156 A * 5/1961 Scheiterlein ..... 123/54.4

FOREIGN PATENT DOCUMENTS

JP 2033415 2/1990
JP 3-107535 * 5/1991

* cited by examiner

*Primary Examiner*—Noah P. Kamen
(74) *Attorney, Agent, or Firm*—Adams & Wilks

(57) ABSTRACT

A V-2 engine includes two cylinder blocks mounted to a crankcase such that the respective cylinder axes of the cylinder blocks extend at an angle to each other and merge together at the axis of a crankshaft with the angle formed between the cylinder axes being divided into two angle parts by a centerline of the crankcase passing through the axis of the crankshaft, and an auxiliary machine mounted to the crankcase on the same side as one of the cylinder blocks when viewed from the axis of the crankshaft. In order to reduce the maximum width of the engine, the cylinder blocks are offset from a symmetric position with respect to the centerline of the crankcase to such an extent that a straight line circumscribing an outer end of a head cover attached to the one cylinder block and an outer end of the auxiliary machine is in parallel to the centerline of the crankcase.

1 Claim, 9 Drawing Sheets

V-2 ENGINE

BACKGROUND OF THE INVENTION

1. Field of the Invention

This invention relates to an improvement in a two-cylinder V-type spark-ignition engine, generally called a V-2 engine.

2. Description of the Related Art various V-2 engines are known and one example of such known V-2 engines is disclosed in Japanese Patent Laid-open Publication No. HEI-2-33415. The disclosed engine is of the vertical type having a crankshaft extending vertically with two cylinders mounted to a crankcase being arranged at an angle to each other in a horizontal plane. The engine is installed in the body of an automotive lawn mower in such a manner that respective tops of the cylinders are directed toward the forward direction of the automotive lawn mower.

Since the two cylinders of the known V-2 engine are arranged symmetrically with respect to the longitudinal axis of the automotive lawn mower, the maximum width of the engine (i.e., the distance between the light-hand end of a head cover of the left cylinder and the right-hand end of a head cover of the right cylinder) is relatively large. The V-2 engine having such a relatively large maximum width gives rise to a problem when installed in a vehicle having a limited width.

In a motorized working machine such as automotive lawn mower, it may occur that the existing engine, namely, an engine currently installed in the vehicle is replaced by another engine of different power or displacement in order to cope with a change in the working load. For instance, a single cylinder engine is replaced with a v-2 engine or vise versa on the same vehicle body. Accordingly, for the V-2 engine, it is desirable to reduce the size to an extent which is comparable to the size of the single cylinder engine. Since the overall size of the V-2 engine is determined by the width, that is, the outside distance between the two cylinder blocks, efforts for downsizing the V-2 engine are essentially focused on reduction of the width.

SUMMARY OF THE INVENTION

It is accordingly an object of the present invention to provide a compact V-2 engine having an arrangement which is capable of reducing the maximus size in the direction of width of the V-2 engine.

According to the present invention, there is provided a V-2 engine comprising: a crankshaft rotatably supported in a crankcase, the crankcase having a centerline passing through the axis of the crankshaft; two cylinder blocks each having one head cover and mounted to the crankcase such that the respective cylinder axes of the cylinder blocks extend at an angle to each other and merge together at the axis of the crankshaft, with the angle formed between the cylinder axes being divided into two angle parts by the centerline of the crankcase; and an auxiliary machine mounted to the crankcase on the same side as one of the cylinder blocks when viewed from the axis of the crankshaft. The cylinder blocks are offset from a symmetric position with respect to the centerline of the crankcase to such an extent that a straight line circumscribing an outer end of the head cover of the one cylinder block and an outer end of the auxiliary machine is in parallel to the centerline of the crankcase.

By thus offsetting the cylinder blocks from the symmetric position with respect to the centerline of the crankcase, the maximum width of the V-2 engine as measured in a direction perpendicular to the crankcase centerline becomes smaller than that of a conventional V-2 engine with cylinder blocks arranged symmetrically with respect to the crankcase centerline. The V-2 engine having a reduced maximum width requires less space for installation than the conventional V-2 engine and, hence, can reduce the overall size of a machine or equipment in which the engine is installed.

The above and other object, features and advantages of the present invention will become manifest to those versed in the art upon making reference to the following description and accompanying sheets of drawings in which a preferred structural embodiment incorporating the principle of the invention is shown by way of illustrative example.

DETAILED DESCRIPTION OF THE PREFERRED EMBODIMENT

The following description is merely exemplary in nature and is in no way intended to limit the invention or its application or use.

Figure 1:
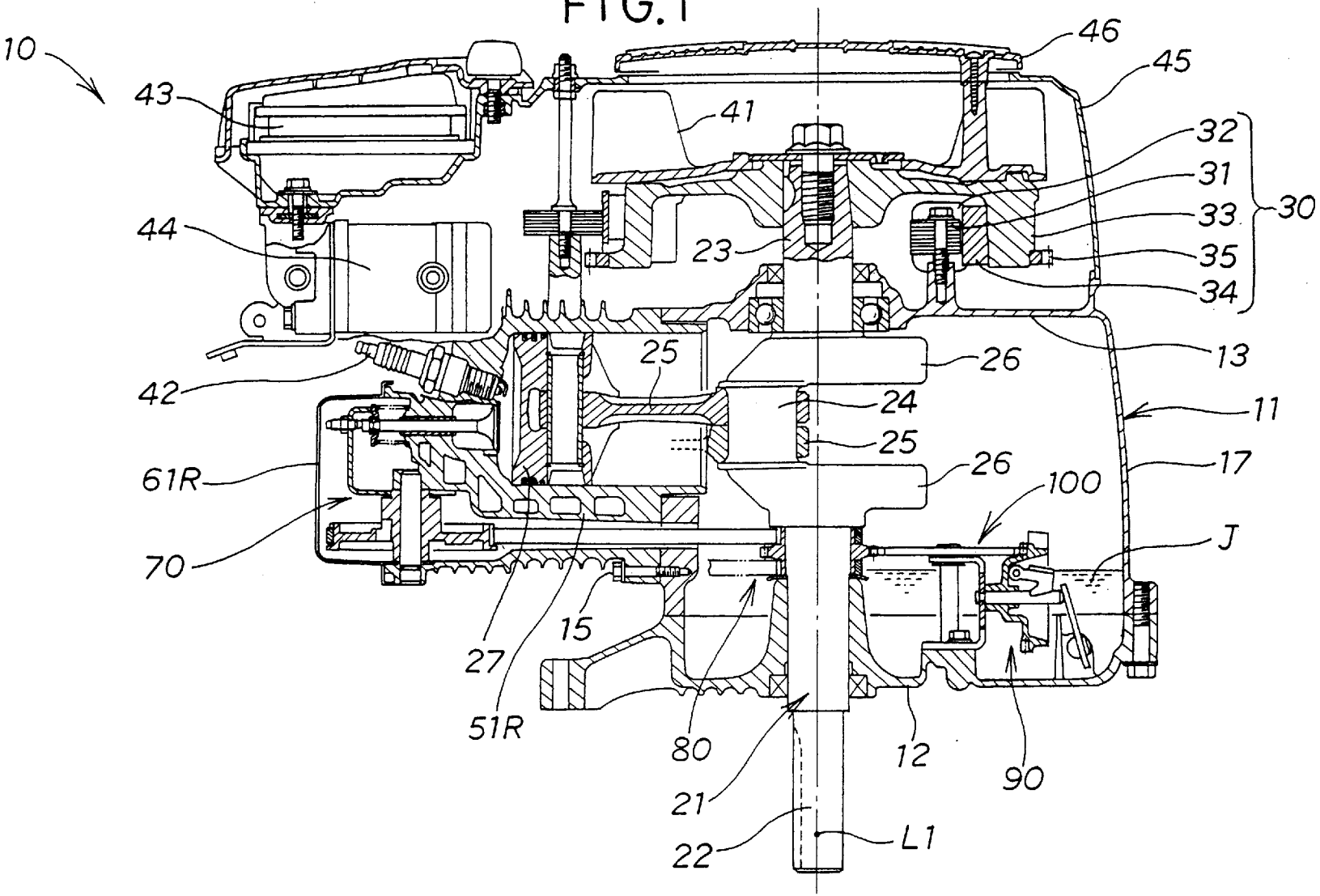
FIG. 1 is a vertical cross-sectional view of an OHC V-2 engine according to an embodiment of the present invention.

Referring to FIG. 1, there is shown an OHC V-2 engine according to an embodiment of the present invention. As shown the engine 10 is of the vertical type including a crankshaft 21 extending vertically with two cylinder blocks (only one designated at 51R being shown) laid horizontally.

The vertical OHC V-2 engine 10 includes a crankcase 11 having a generally inverted cup-shaped configuration with one end open downward, and a lid 12 attached by screws (only one being shown) to the crankshaft 11 so as to close the open end of the crankcase 11. The vertically extending crankshaft 21 is rotatably mounted in the crankcase 11 and has longitudinal opposite end portions 22, 23 journaled on the crankcase 11 and the lid 12, respectively, via a pair of bearings (not designated). The lower end portion 22 of the crankshaft 21 projects downward from the lid 11 and forms a power take out portion of the engine 10. The upper end portion 23 projects upward from an upper wall 13 of the crankcase 11 for a purpose described below.

The crankshaft 21 has a longitudinal central portion forming a single offset journal or crankpin 24 to which two connecting rods 25 and 25 are attached side-by-side.

The engine 10 is equipped with an alternator 30 and a cooling fan 41 disposed above the crankcase 11.

Figure 2:
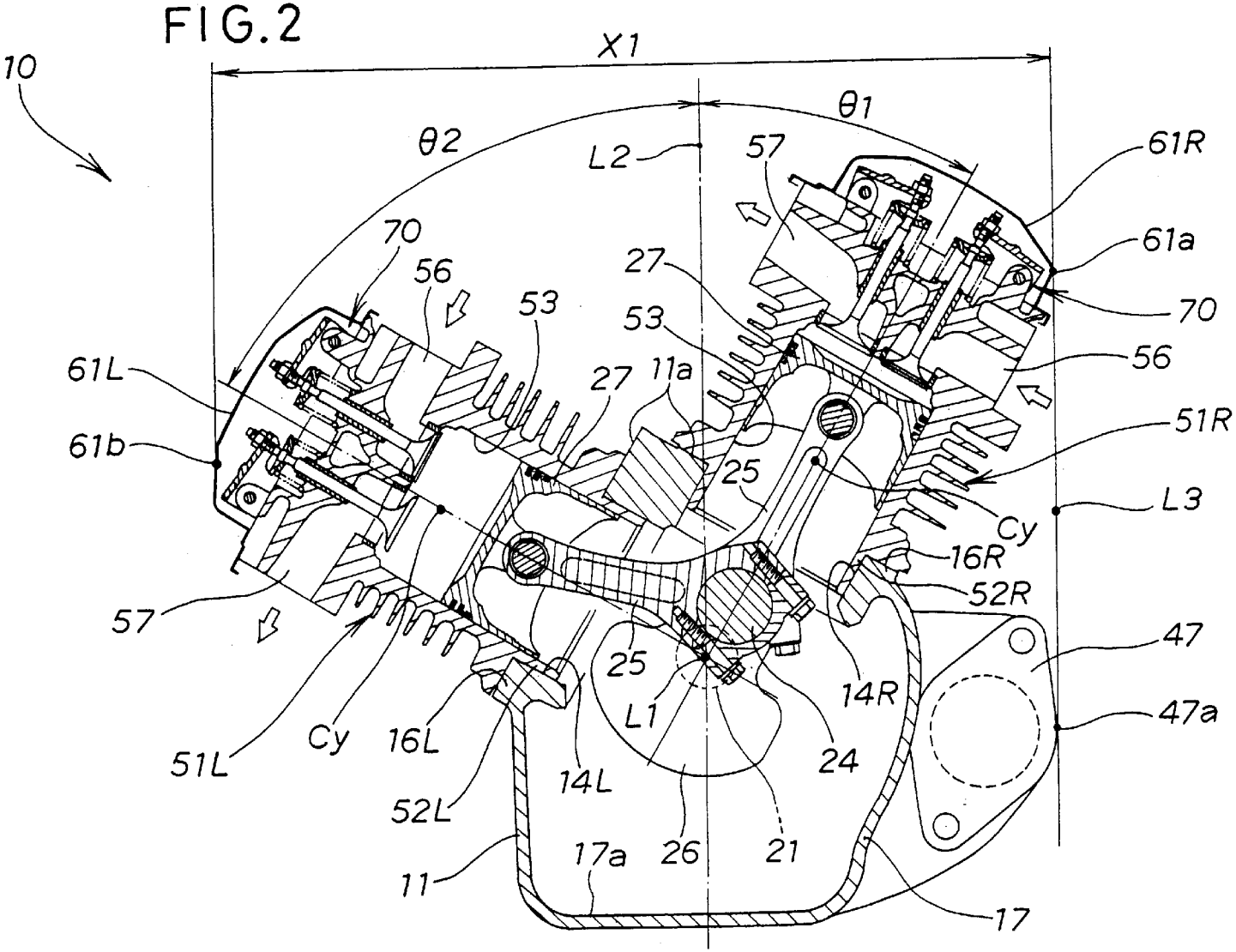
FIG. 2 is a horizontal cross-sectional view of the OHC V-2 engine.

The alternator 30 comprises an outer rotor type multi-pole magnetoelectric generator and has an outer rotor 33 attached to the upper end portion 23 of the crankshaft 21. The alternator 30 also has an inner stator frame 31 mounted to the upper wall 13 of the crankcase 11, stator windings 32 wound on the stator frame 31, and a permanent magnet 34 attached to an inner circumferential surface of the outer rotor 33. The outer rotor 33 has a driven ring gear 35 formed on an outer circumferential surface thereof and adapted to be driven by a driving gear (not shown) of a starting motor 47 (FIG. 2).

The cooling fan 41 is attached to the upper end portion 23 of the crankshaft 21 and is directly driven in rotation by the crankshaft 21 for cooling the engine. The cooling fan 41 is disposed on an upper side of the outer rotor 33 of the alternator 30.

Thus, one end portion (upper end portion) 23 of the crankshaft 21 supports thereon the outer rotor 33 of the alternator 30 and the cooling fan 41, while the other end portion (lower end portion) 22 of the crankshaft 21 forms the power take out portion of the engine 10.

In FIG. 1, reference numerals 26, 26 denote crank webs of the crankshaft 21. Similarly, reference numerals 42, 43 and 44 denote an ignition plug, an air-cleaner, and a carburetor of the engine 10, respectively. Reference numeral 45 denotes an alternator case in which the alternator 30 is housed, and reference numeral 46 is a cover located above an upper opening (not designated) of the alternator case 45.

As shown in FIG. 2, the engine 10 further has two cylinder blocks 51L, 51R attached by screws 15 (one being shown in FIG. 1) to the crankcase 11 so that they are arranged at an angle to each other about the axis L1 of the crankshaft 21. That is, the respective cylinder axes Cy, Cy of the cylinder blocks 51L, 51R merging together at the axis L1 of the crank-shaft 21 forms a V shape. The cylinder blocks 51L, 51R have a mounting end 52L, 52R fitted in each of two mounting holes 14L, 14R formed in a sidewall 17 of the crankcase 11. The angle between the cylinder blocks 51L, 51R, that is, the bank angle is approximately 90 degrees. The screws 15 (FIG. 1) may be replaced by stud bolts and nuts used in combination.

The cylinder blocks 51L, 51R are offset from each other in the axial direction of the crankshaft 21 so that the connecting rods 25, 25 can be disposed side by side on the single crankpin 24.

The sidewall 17 of the crankcase 11 includes a generally flat portion 17*a* opposite to the mounting holes 14L, 14R. The crankcase 11 has a centerline L2 which is orthogonal to the flat sidewall portion 17*a* and passing through the axis L1 of the crankshaft 12. In FIG. 2, the starter motor 47 serving as an auxiliary device of the engine 10 is disposed adjacent to the crankcase 11 on the same side (right-hand side in FIG. 2) as he right cylinder block 51R when viewed from the centerline L2 of the crankcase 11.

As shown in FIG. 2, the cylinder blocks 51L, 51R are offset from a symmetric position with respect to the centerline L2 of the crankcase 11 to such an extent that a straight line L3 circumscribing an outer end portion 47*a* (right-hand end in FIG. 2) of the starter motor 47 and an outer end portion 61*a* (right-hand end in FIG. 2) of a head cover 61R attached to the cylinder block 51R is in parallel to the centerline L2 of the crankcase 11. Thus, in a horizontal plane, the cylinder axis Cy of the right cylinder head 51R is offset rightward from the centerline L2 of the crankcase 11 by an angle θ1 which is smaller than the angle θ2 formed between the cylinder axis Cy of the left cylinder head 51L and the centerline L2 of the crankcase 11. A maximum width X1 of the engine 10 is equal to the distance between the right-hand end 61*a* of the head cover 61R attached to the right cylinder block 51R and the left-hand end 61*b* of a head cover 61L attached to the left cylinder block 51L, as measured in a direction perpendicular to the centerline L2 of the crankcase 11.

Figure 3:
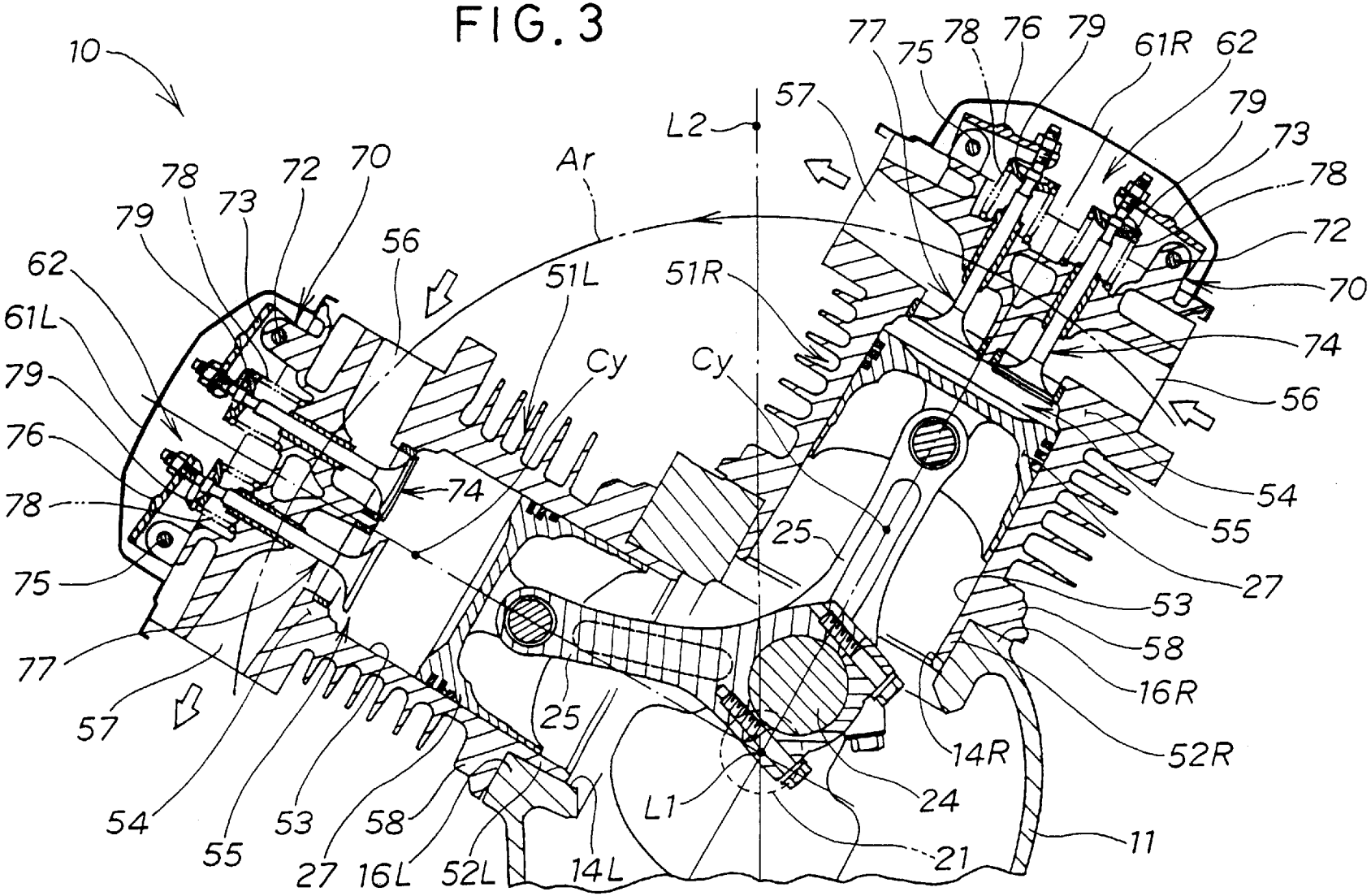
FIG. 3 is an enlarged view of a portion of FIG. 2.

Reference is next made to FIG. 3 which is an enlarged view of a portion of FIG. 2. As shown, the left cylinder block 51L and related parts thereof are identical in construction to the right cylinder block 51R and related parts thereof. Accordingly, a description given below will be limited to only the right cylinder block 51R and its related parts. The left cylinder block 51L and related parts thereof are merely designated by the same reference characters and no further description thereof is needed.

The cylinder block 51R is of the so-called "unitary block" type and includes a cylinder 53 formed therein and extending along the cylinder axis Cy, and a cylinder head 54 formed integrally with an upper part of the cylinder block 51R so as to cover the top of the cylinder 53. The piston 27 is slidably received in the cylinder 53 for reciprocating movement along the cylinder axis Cy, there being a combustion chamber 55 defined between the top of the piston 27 and the bottom of the cylinder head 54. The cylinder head 54 has an intake port 56 and an exhaust port 57 formed therein in diametrically opposed relation to each other. The piston 27 is connected by the connecting rod 25 to the crankpin 24 of the crankshaft 21 so that when the piston 25 slides up and down along the cylinder 53, the crankshaft 21 is forced to rotate by the piston 27 via the connecting rod 25.

The head cover 61R is attached by screws (not shown) to the top of the cylinder head 54 so as to define therebetween a valve chamber 62 in which a valve mechanism 70 is disposed.

The valve mechanism 70 is mounted to the cylinder head 54 and essentially has a camshaft 71 (FIG. 5), an intake valve 74, a rocker shaft 72 for the intake valve 74, a rocker arm 73 for the intake valve 74, an exhaust valve 77, a rocker shaft 75 for the exhaust valve 77, and a rocker arm 76 of the exhaust valve 77. Each valve 74, 77 is urged in a closed position by one valve spring 78. The valve spring 78 acts between the cylinder head 54 and a retainer 79 attached to an upper end of the valve 74, 77.

The left and right cylinder blocks 51L, 51R of the identical construction are oriented in the same direction relative to the crankcase 11 so that the intake port 56 of the right cylinder head 54, the exhaust port 57 of the right cylinder head 54, the intake port 56 of the left cylinder head 54 and the exhaust port 57 of the left cylinder head 54 are arranged in succession in the order named when viewed in the counterclockwise direction along an arc Ar drawn about the axis L1 of the crankshaft 21.

Figure 4:
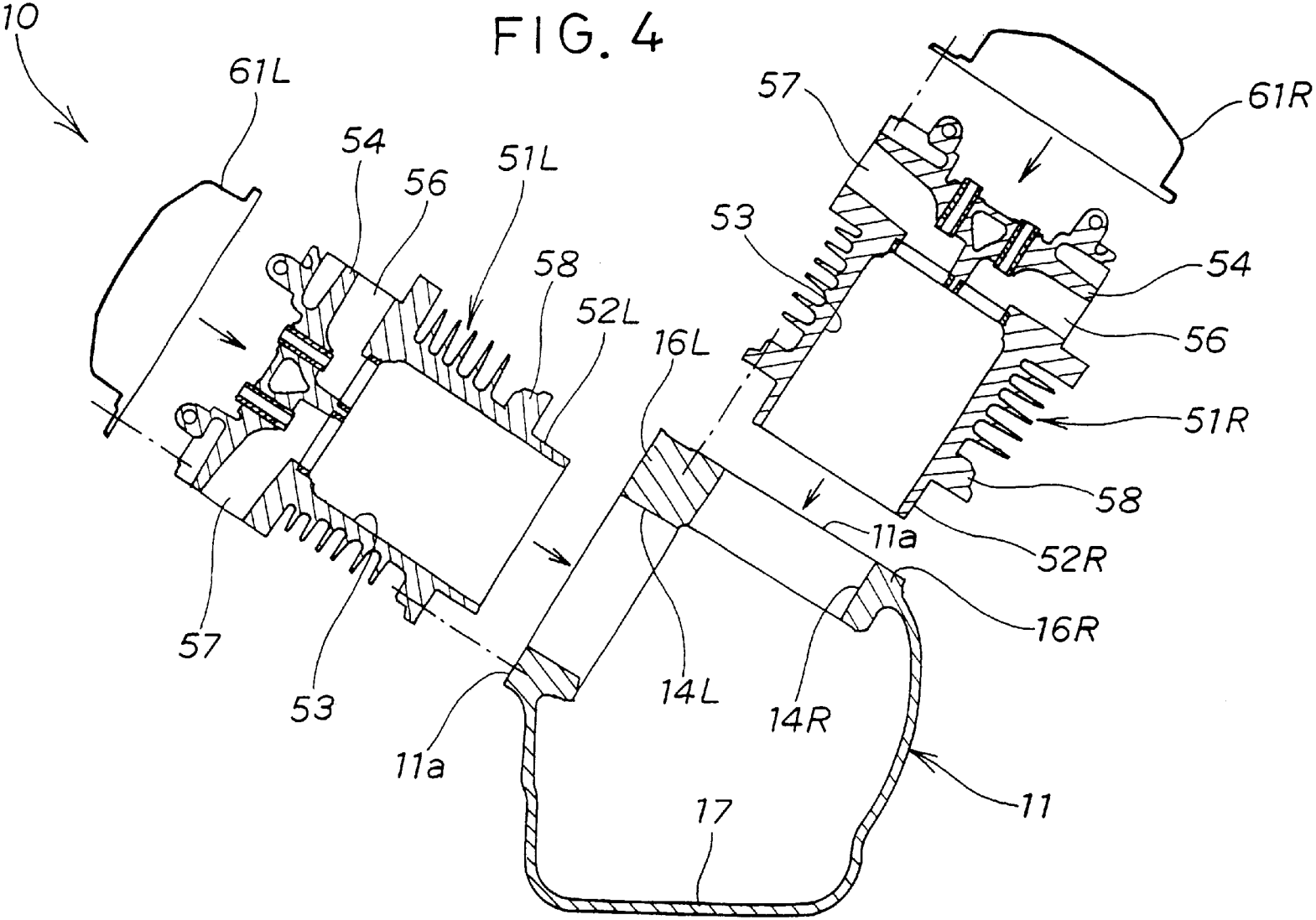
FIG. 4 is an exploded horizontal cross-sectional view of the OHC V-2 engine.

FIG. 4 illustrates the manner in which the cylinder blocks 51L, 51R, head covers 61L, 61R and crankcase 11 are assembled together.

As shown in FIG. 4, the mounting end 52L, 52R of each cylinder block 51L, 51R is fitted into a corresponding one of the mounting holes 14L, 14R of the crankcase 11 until a mounting flange 58 of the cylinder block 51L, 51R is in face to face contact with an upper surface 11*a* of a mounting seat 16L, 16R of the crankcase 11. Then, the cylinder blocks 51L, 51R are firmly secured to the crankcase 11 by means of screws (not shown but identical to the screw 15 shown in FIG. 1). The head covers 61L, 61R are attached by screws (not shown) to the cylinder heads 54, 54 of the corresponding cylinder blocks 51L, 51R. Due to the connection using the threaded fasteners, the cylinder blocks 51L, 51R and the head covers 61L, 61R can be detached from the crankcase 11 and the cylinder blocks 51L, 51R, respectively, when the need arises for repair or maintenance.

Figure 5:
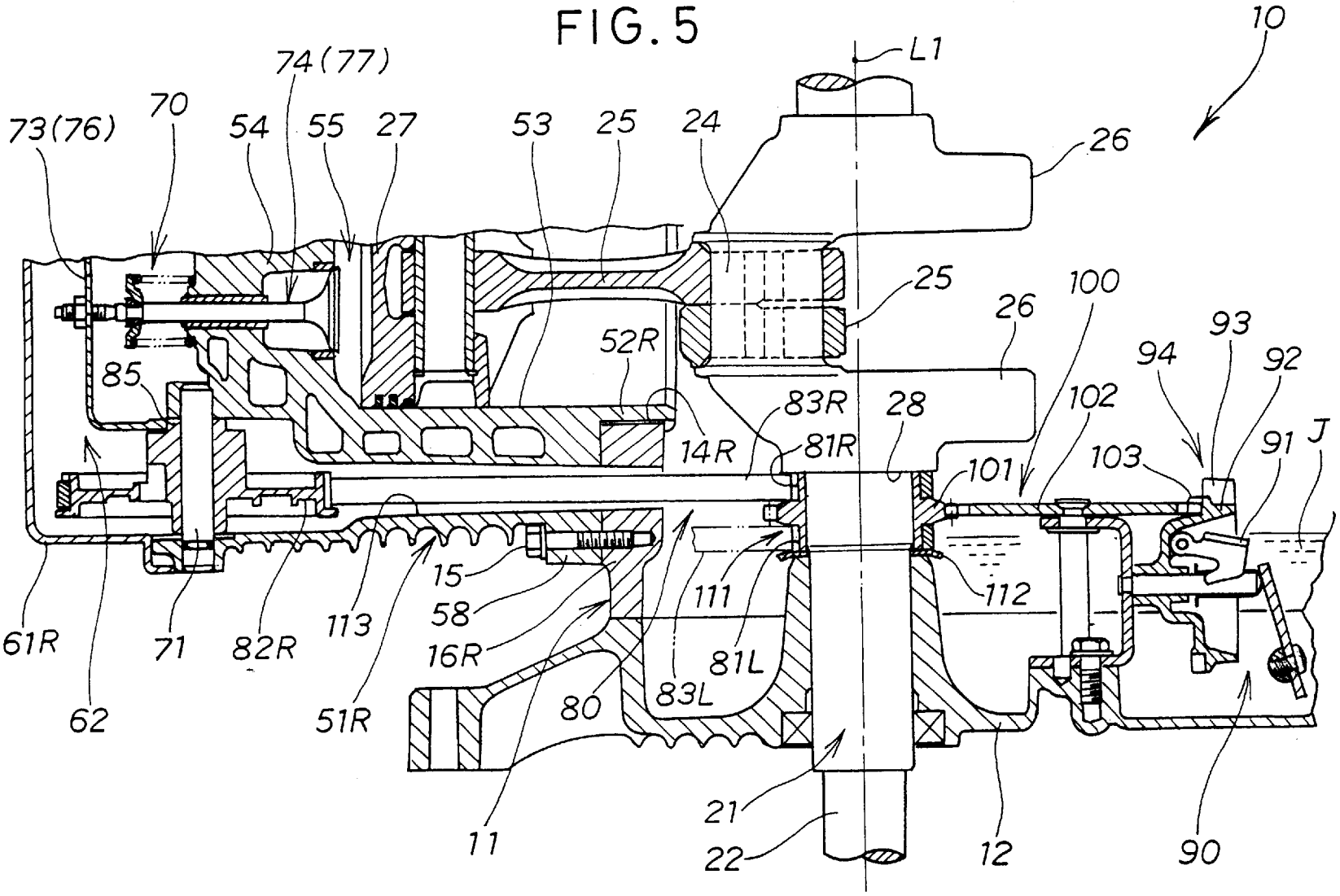
FIG. 5 is an enlarged view of a portion of FIG. 1.

Reference is next made to FIG. 5 which shows on enlarged scale a lower part of the OHC V-2 engine 10 shown in FIG. 1.

The engine 10 further comprises a power transmitting mechanism 80 for transmitting power from the crankshaft 21 to the camshafts 71 to thereby drive the valve mechanisms 70, and a centrifugal governor mechanism 90 disposed in the crankcase 11 adjacent to the lid 12 or the bottom of the crankcase 11 for a purpose described below.

The camshaft 71 is rotatably supported by the cylinder head 54 of the right cylinder block 51R. A driven pulley 82R is connected to the camshaft 71 and has a cam 85 formed integrally with the driven pulley 82R. The cam 85 is held in driving engagement with the rocker arms 73, 76 of the intake and exhaust valves 74, 77 of the valve mechanism 70 so that when the cam 85 rotates about the axis of the camshaft 71 in response to rotation of the driven pulley 82R, the rocker arms 73, 75 are caused to rock or oscillate to thereby open and close the intake and exhaust valves 74, 77 with prescribed valve timing. The foregoing description may be applied to the corresponding mechanism associated with the left cylinder block 51L.

Figure 6:
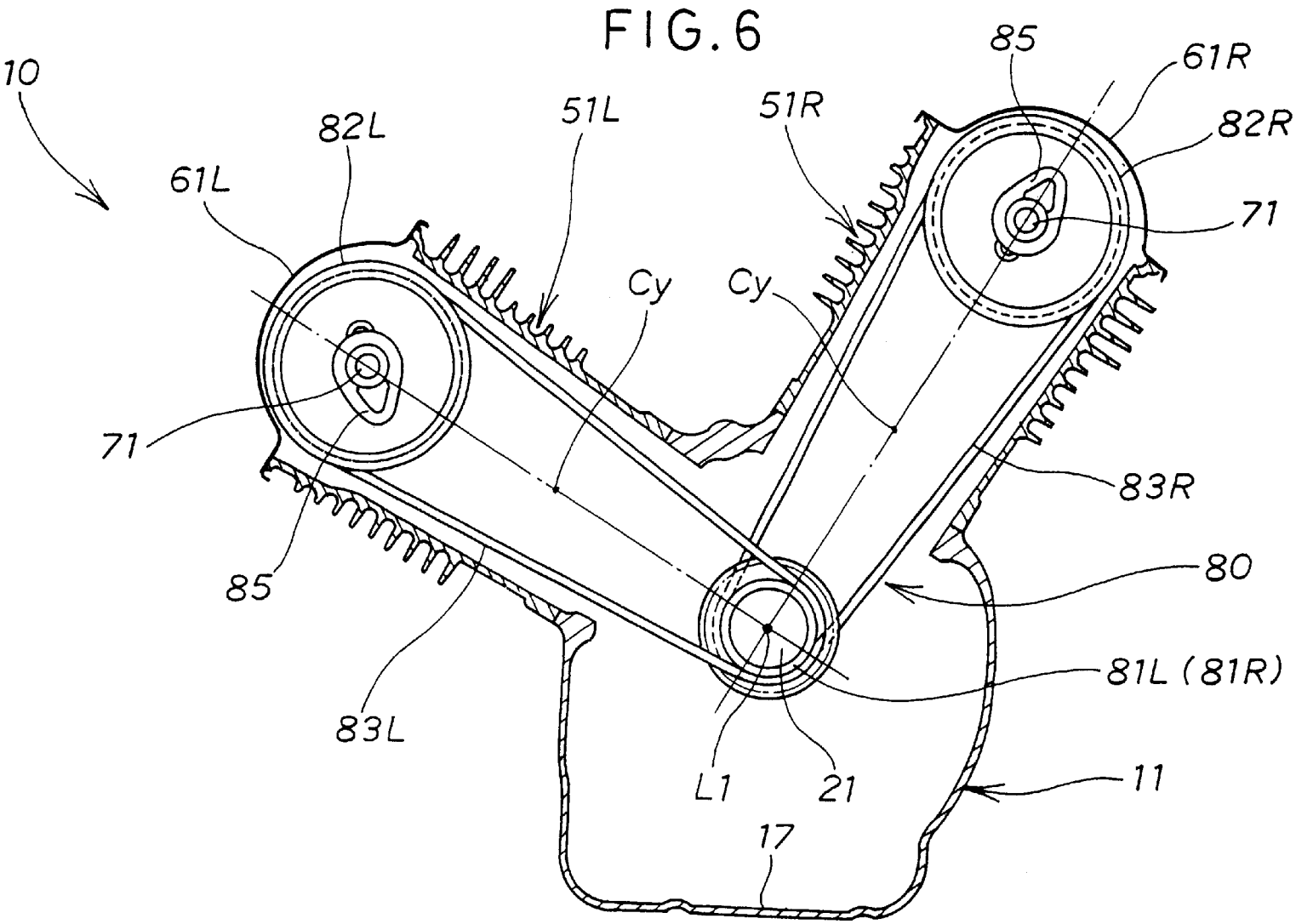
FIG. 6 is a horizontal cross-sectional view of the OHC V-2 engine, showing the general construction of a power transmitting mechanism for transmitting power from a crankshaft to camshafts of the engine.

As shown in FIG. 6, the power transmitting mechanism 80 comprises two identical driving pulleys 81L and 81R connected in tandem to the crankshaft 21 within the crankcase 11, two identical driven pulleys 82L, 82R connected to the camshafts 71 of the left and right cylinder blocks 51L, 51R, and two identical driving belts 83L, 83R each trained around one pair of driving and driven pulleys 81L and 82L; 81R and 82R. The driving belts 83L, 83R comprise a toothed timing belt, and the driving and driven pulleys 81L, 81R and 82L, 82R comprise a toothed pulley.

By using two timing belt drives of identical construction, the same component is used in common to both belt drives. Accordingly, considerable reduction of the manufacturing cost can be achieved.

Referring back to FIG. 5, the centrifugal governor mechanism 90 is actuated by the centrifugal force of a whirling weight 91 opposed by gravity or by a spring (not shown), and is used to control the engine speed by adjusting the amount of fuel to be injected from a fuel injection device (not shown) of the engine 10 on the basis of the rotational speed of the crankshaft 21.

The whirling weight 91 is pivotally connected to a cup-shaped rotating holder 92 rotatably mounted on a horizontal shaft (not designated) connected at one end to a vertical bracket (not designated) secured by screws (one being shown) to the lid 12 of the crankcase 11. Thus, the cup-shaped rotating holder 92 is rotatable about an axis perpendicular to the axis of the crankshaft 21. The holder 92 has a plurality of circumferentially spaced oil splashing projections or slingers 93 (only one being shown) formed on the outer circumference thereof.

A lower part of the cup-shaped rotating holder 92 dips below a lubricating oil J held or collected at the bottom of the crankcase 11 so that when the cup-shaped rotating holder 92 is rotating by the rotational power of the crankshaft 21, the oil splashing projections 93 can continuously draw up the lubricating oil from the bottom of the crankcase 11 and subsequently splash the lubricating oil over the parts held inside the crankcase 11. Part of the splashed lubricating oil adheres to the driving belts 83L, 83R either directly or through a peripheral component and is carried by the driving belts 83L, 83R toward the valve mechanisms 70 of the engine 10. Thus, the oil splashing projections 93 of the centrifugal governor mechanism 90 and the driving belts 83L, 83R of the power transmitting mechanism 80 jointly constitute a lubricating device or mechanism 94, as will be described later.

A governor driving mechanism 100 for rotatably driving the cup-shaped rotating holder 92 of the centrifugal governor mechanism 90 has a driving gear 101 attached to the crankshaft 21, an intermediate gear 102 meshing with the driving gear 101 and rotatably mounted on a vertical shaft (not designated) connected to the lid 12, and a driven gear 103 meshing with the intermediate gear 102 and formed on an end face of the cup-shaped rotating holder 92.

As shown in FIG. 5, the driving gear 101 of the governor driving mechanism 100 and the driving pulleys 81L, 81R of the power transmitting mechanism 80 are formed integrally with each other, and the driving pulleys 81L, 81R are disposed on opposite sides of the driving gear 101. The driving gear 101 and the driving pulleys 81L, 81R jointly form an integrated driving member 111. The integrated driving member 111 is directly connected to the power take out portion 22 of the crankshaft 21. The driving pulleys 81L, 81R are both disposed on the same side (power take-out end side) of the crankshaft 21. Use of the integrated driving member 111 can reduce a number of structural components used and also can prevent lateral displacement or oscillation of the driving belts 83L, 83R trained around the corresponding driving pulleys 81L, 81R.

The pitch or distance between the two laterally spaced driving pulleys 81L and 81R is substantially equal to the pitch or distance between the two connecting rods 25, 25 arranged in tandem in the longitudinal direction of the crankshaft 21.

A ring-like belt guide 112 is mounted on the crankshaft 21 and disposed between the driving pulley 81L (i.e., one end of the integrated driving member 111) and a boss (not designated) of the lid 12 for slidably guiding an outside edge of the driving belt 83L. Similarly, the crank web 26 of the crankshaft 21 has a central boss 28 of enlarged diameter disposed in abutment with an end face of the driving pulley 81R (i.e., the opposite end of the integrated driving member 111) for slidably guiding an outside edge of the driving belt 83R. Respective inside edges of the driving belts 83L, 83R are guided by opposite end faces of the driving gear 101. Reference numeral 113 denotes a belt passageway provided in the cylinder block 51R for the passage of the driving belt 83R. Though not shown in FIG. 5, the cylinder head 51L has a similar belt passageways for the passage of the driving belt 83L.

Figure 7:
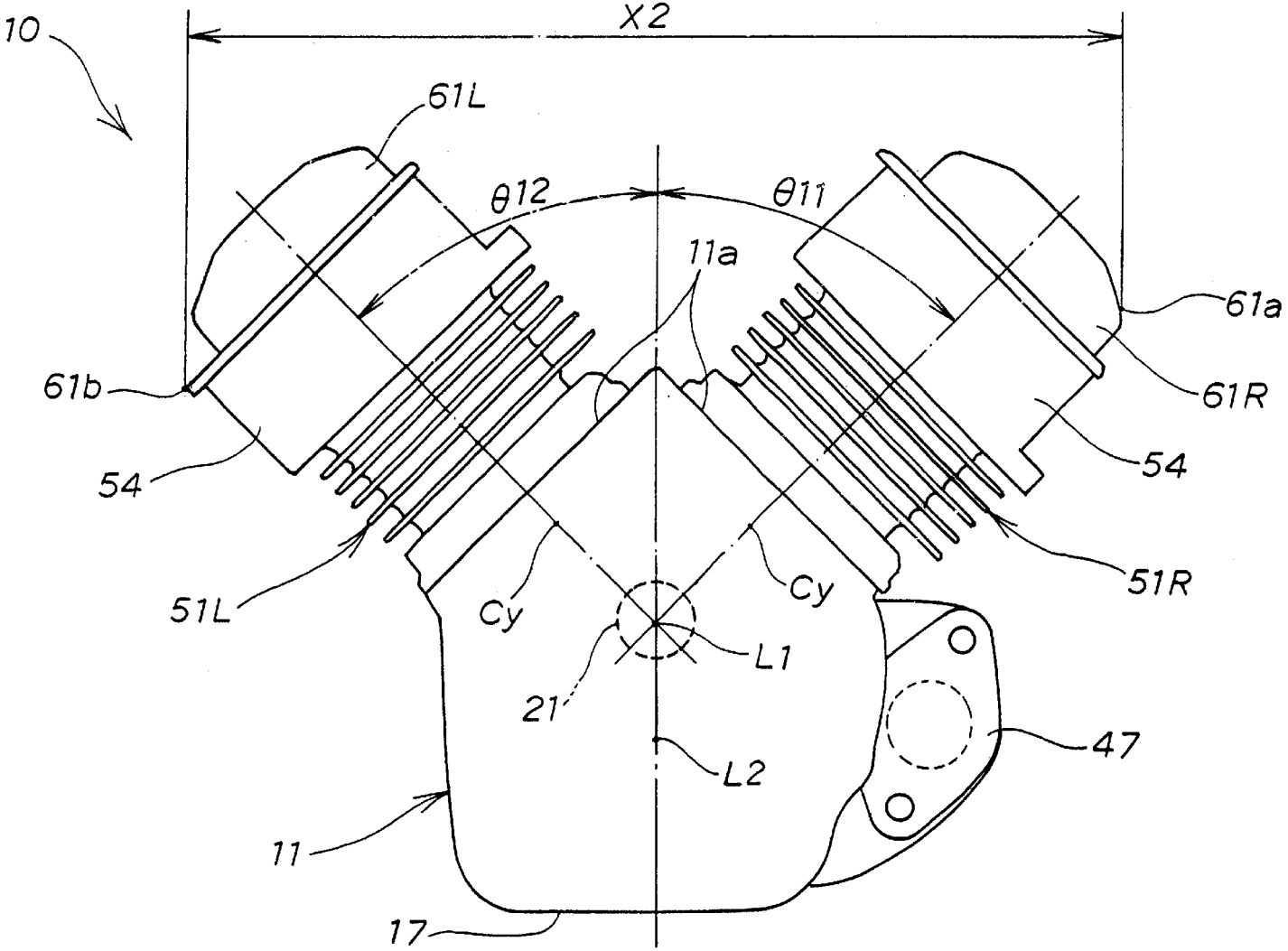
FIG. 7 PRIOR ART
FIG. 7 is a plan view showing a comparative example of the arrangement of cylinders in the V-2 engine.

FIG. 7 shows, for comparative purposes, an arrangement of two cylinders generally used in a conventional V-2 engine 100. According to this arrangement, two cylinder blocks 51L, 51R are disposed in a symmetric position with respect to the centerline L2 of the crankcase 11. The left cylinder block 51L is offset leftward from the centerline L2 by an angle θ12, and the right cylinder block 51R is offset rightward from the centerline L2 by an angle θ11 which is equal to the offset angle θ12 of the left cylinder block 51L. By virtue of the symmetric arrangement of the cylinder blocks 51L, 51R, the V-2 engine 100 has a maximum width X2 which is corresponding to the distance between the left end of a head cover 61L attached to the left cylinder block 51L and the right end of a head cover 61R attached to the right cylinder block 51R, as measured in a direction perpendicular to the centerline L2 of the crankcase 11.

It will be understood that the distance X11 itself can be reduced to a minimum by turning the cylinder blocks 51L, 51R counterclockwise in FIG. 7 about the axis L1 through an angle θ11, thereby placing the left and right cylinder blocks 51L, 51R in a recumbent position and a upright position, respectively. In this instance, however, the starter motor 47 disposed on the right-hand side of the crankcase 11 projects laterally outward from a right-hand end of the right cylinder block 51R. Thus, no substantial reduction of the overall width of the V-2 engine 100 is achieved.

According to the present invention, as described previously with reference to FIG. 2, the starter motor 41 is disposed adjacent to the crankcase 11 on the same side as one of the cylinder blocks 51L, 51R when viewed from the axis L1, and the cylinder blocks 51L, 51R are offset from a symmetric position with respect to the centerline L2 of the crankcase 11 to such an extent that a straight line L3 circumscribing an outer end 61*a* of the head cover 61R attached to the one cylinder block 51R and an outer end 47*a* of the starter motor 47 is in parallel to the centerline L2 of the crankcase 11. With this asymmetric arrangement, the the angle θ1 between the one cylinder 51R and the centerline L2 becomes smaller than the angle θ2 between the other cylinder block 51L and the centerline L2. The starter motor 47 has no portion projecting laterally outward from the outer end of the cylinder head cover 61R attached to the one cylinder brock 51R.

It appears clear from FIGS. 2 and 7, the overall width X1, X2 of the V-2 engine as measured in a direction perpendicular to the centerline L2 of the crankcase 11 is smaller in the V-2 engine 10 (FIG. 2) of the present invention than in the conventional V-2 engine 100 (FIG. 7). Thus, the arrangement of the present invention achieves substantial downsizing of the V-2 engine.

It can be appreciated that if the starter motor is mounted to the left-hand side of the crankcase 11, the cylinder blocks 51L, 51R will be offset from a symmetric position with respect to the centerline L2 of the crankcase 11 to such an extent that a line circumscribing the left-hand end of the head cover 61L attached to the left cylinder block 51L and the left-hand end of the starter motor 47 is in parallel with the centerline L2 of the crankcase 11. In this arrangement, the angle θ2 between the left cylinder block 51L and the centerline L2 becomes smaller than the angle θ1 between the right cylinder block 51R and the centerline L2.

The V-2 engine of the present invention can be used as a power unit of various working machines, motorcycles, automotive lawn mowers, outboard motors, etc. Typical examples of such applications will be described with reference to FIGS. 8 and 9.

Figure 8A:
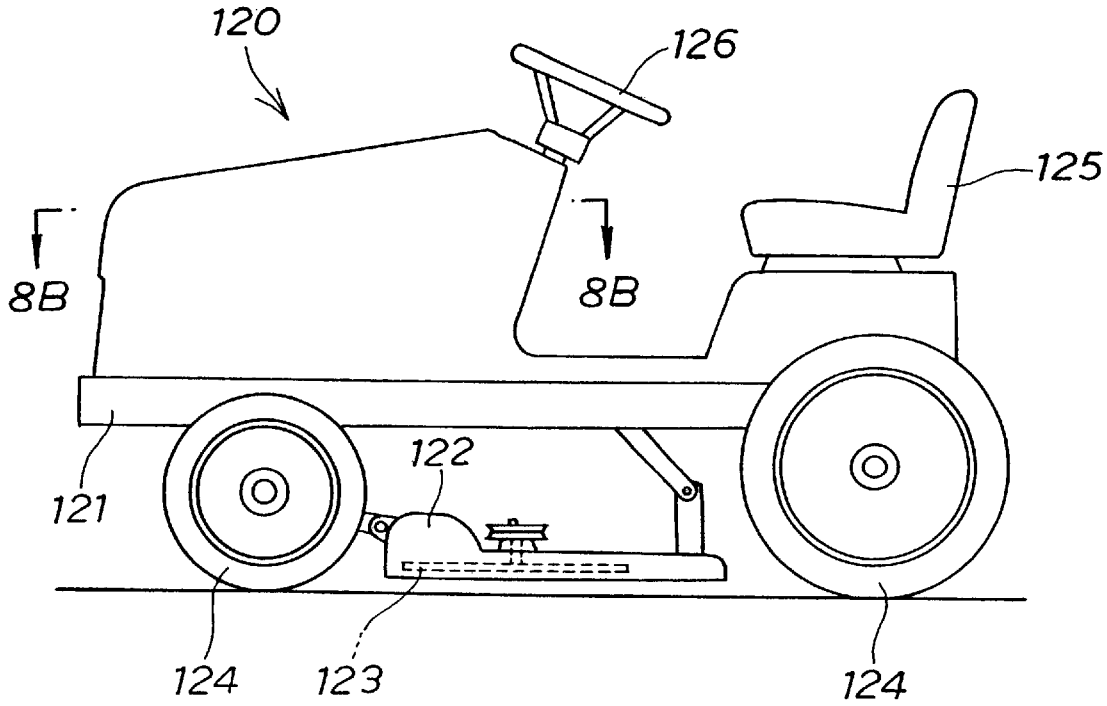
FIG. 8A is a schematic side view of an automotive lawn mower in which the OHC V-2 engine of the present invention is installed.
Figure 8B:
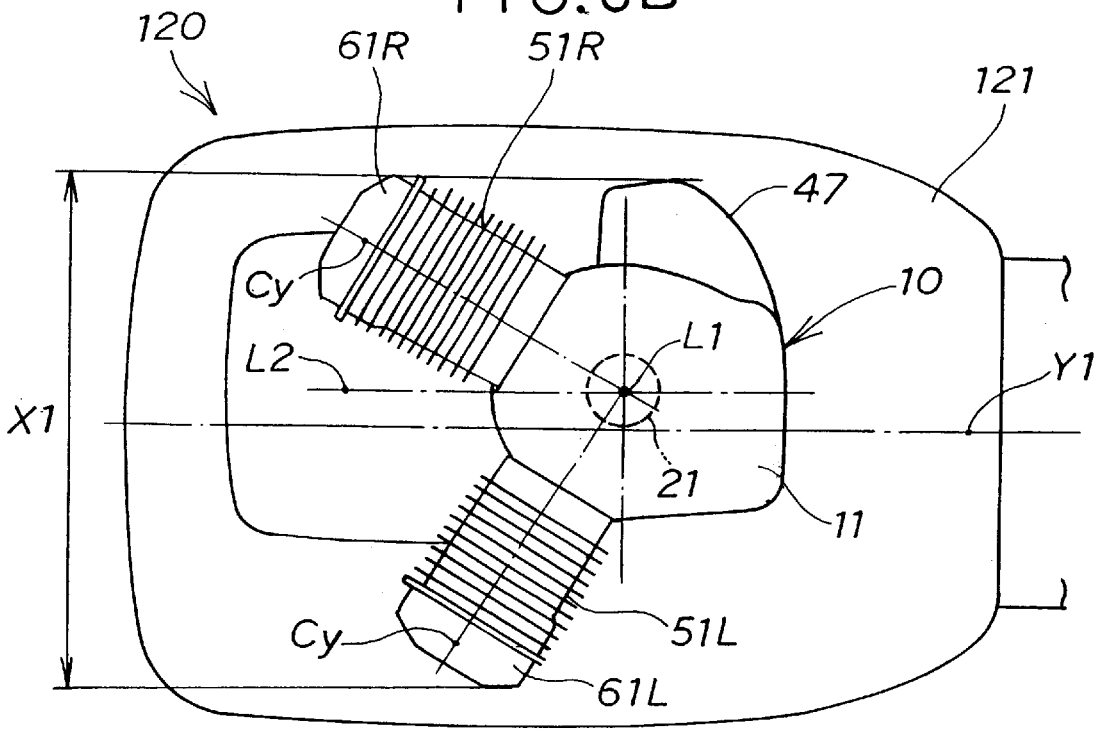
FIG. 8B is a diagrammatical cross-sectional view taken along line 8B—8B of FIG. 8A, showing the OHC V-2 engine of the present invention installed in the automotive lawn mower.

In the application shown in FIGS. 8A and 8B, the V-2 engine 10 (FIG. 8B) is installed in an automotive lawn mower 120. The lawn mower 120 includes a cutter housing 122 disposed below a vehicle body 121, and a mowing cutter 123 rotatably mounted within the housing 122 and driven in rotation by the V-2 engine. In FIG. 8A, reference numerals 124, 125 and 126 denote wheels, a seat and a steering wheel, respectively, of the automotive lawn mower 120.

As shown in FIG. 8B, the engine 10 is mounted on a front part of the vehicle body 121 in such a manner that the crank-shaft 21 extends vertically and the left and right cylinder blocks 51L, 51R lying in a horizontal plane with respective head covers 61L, 61R directed toward the forward direction of the vehicle body 121. Because of the asymmetric arrangement of the cylinder blocks 51L, 51R with respect to the centerline L2 of the crankcase 11, the centerline L2 of crankcase 11 is offset rightward of the vehicle body 121 from a longitudinal axis Y1 of the vehicle body 121. Since the V-2 engine 10 according to the present invention has a smaller width X1 than the conventional V-2 engine 100 (FIG. 7) with symmetrically arranged cylinder blocks, the width of the vehicle body 121 can be reduced.

Figure 9A:
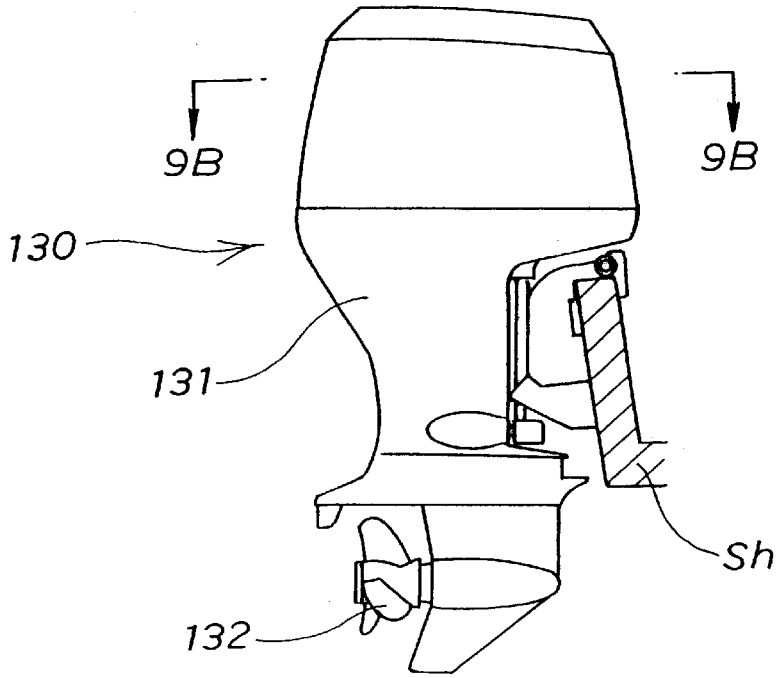
FIG. 9A is a side view of an outboard motor in which the OHC V-2 engine of the present invention is installed.
Figure 9B:
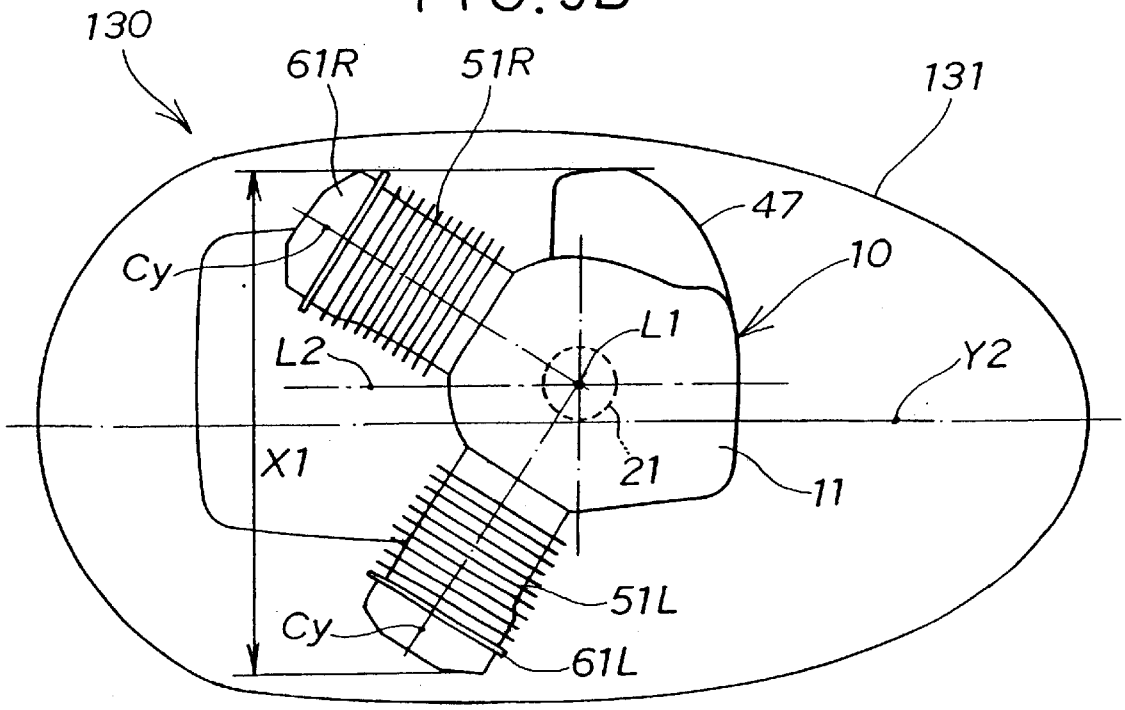
FIG. 9B is diagrammatical cross-sectional view taken along line 9B—9B of FIG. 9A, showing the OHC V-2 engine of the present invention installed in the outboard motor.

In the application shown in FIGS. 9A and 9B, the V-2 engine 10 (FIG. 9B) is installed in an outboard motor 130 adapted to be attached to a rear end of the body or hull Sh of a boat. The outboard motor 130 includes a hollow body 130 in which the engine 10 (FIG. 9B) is mounted, and a screw-propeller 132 rotatably driven by the engine 10.

As shown in FIG. 9B, the V-2 engine is of the vertical type having a crankshaft 21 disposed vertically and cylinder blocks 51L, 51R disposed horizontally with respective head covers 61L, 61R facing rearward of the body 131 of the outboard motor 130. Owing to the asymmetric arrangement of the cylinder blocks 51L, 51R with respect to the centerline L2 of the crankcase 11, the centerline L2 of the crankcase 11 is offset sideway from the longitudinal axis Y2 of the outboard motor body 131. Since the V-2 engine 10 of the present invention has a smaller width X1 than the conventional V-2 engine 100 (FIG. 7) with symmetrically arranged cylinder blocks, it requires less space for installation than the conventional V-2 engine and can reduce the overall width of the outboard motor 130.

The V-2 engine 10 should by no means be limited to the vertical type as in the illustrated embodiment but may include the horizontal type in which instance the flat sidewall portion 17*a* (FIG. 2) of the crankcase 11 forms a bottom wall of the crankcase 11. The flat wall portion 17*a* may be curved or arcuate.

The starter motor 47 may be replaced with another auxiliary machine or device associated with the engine 10.

The cylinder blocks 51L, 51R should by no means be limited to the unitary structure having an integral cylinder head 54 as in the illustrated embodiment but may include a separate structure having a separate cylinder head.

The respective positions of the cylinder blocks 51L, 51R in the axial direction of the crankshaft 21 are interchangeable.

Obviously, various minor changes and modifications of the present invention are possible in the light of the above teaching. It is therefore to be understood that within the scope of the appended claims, the present invention may be practiced otherwise than as specifically described.

What is claimed is:

1. A V-2 engine comprising:

a crankshaft rotatably supported in a crankcase, the crankcase having a centerline passing through the axis of the crankshaft;

two cylinder blocks each having one head cover and mounted to the crankcase such that the respective cylinder axes of the cylinder blocks extend at an angle to each other and merge together at the axis of the crankshaft with the angle formed between the cylinder axes being divided into two angle parts by the centerline of the crankcase; and an auxiliary machine mounted to the crankcase on the same side as one of the cylinder blocks when viewed from the axis of the crankshaft, wherein the cylinder blocks are offset from a symmetric position with respect to the centerline of the crankcase to such an extent that a straight line circumscribing an outer end of the head cover of the one cylinder block and an outer end of the auxiliary machine is in parallel to the centerline of the crankcase.

* * * * *